US008404986B2

(12) United States Patent
Burghauser et al.

(10) Patent No.: US 8,404,986 B2
(45) Date of Patent: Mar. 26, 2013

(54) MANUAL DRIVE FOR A TAP CHANGER FOR TAP-CHANGING TRANSFORMERS

(75) Inventors: Armin Burghauser, Regensburg (DE); Silke Wrede, Zeitlam (DE)

(73) Assignee: Maschinenfabrik Reinhausen GmbH, Regensburg (DE)

( * ) Notice: Subject to any disclaimer, the term of this patent is extended or adjusted under 35 U.S.C. 154(b) by 301 days.

(21) Appl. No.: 12/989,467

(22) PCT Filed: May 22, 2009

(86) PCT No.: PCT/EP2009/003657

§ 371 (c)(1),
(2), (4) Date: Nov. 30, 2010

(87) PCT Pub. No.: WO2010/012329

PCT Pub. Date: Feb. 4, 2010

(65) Prior Publication Data

US 2011/0102118 A1 May 5, 2011

(30) Foreign Application Priority Data

Aug. 1, 2008 (DE) ..... 10 2008 036 006

(51) Int. Cl.
*H01H 3/20* (2006.01)

(52) U.S. Cl. ..... 200/330; 200/11 TC; 200/17 R; 200/500; 200/318; 200/322; 200/324; 200/331

(58) Field of Classification Search ..... 323/254, 323/255, 340, 341; 439/207, 833; 200/43.01, 200/43.04, 43.08–43.22, 50.01, 50.02, 50.09, 200/50.11, 50.21–50.25, 48 R, 48 A, 11 TC, 200/17 R, 400, 401, 500, 501, 573, 574, 318–325, 200/329–331, 334, 337

See application file for complete search history.

(56) References Cited

U.S. PATENT DOCUMENTS

| | | | | |
|---|---|---|---|---|
| 1,732,742 | A | 10/1929 | Dann | |
| 3,902,030 | A * | 8/1975 | Popa | 200/11 TC |
| 3,992,595 | A * | 11/1976 | Eley | 200/11 TC |
| 4,563,549 | A * | 1/1986 | Lycan | 200/1 V |
| 4,823,231 | A * | 4/1989 | Jego et al. | 361/837 |
| 5,034,584 | A * | 7/1991 | Fanta et al. | 200/329 |
| 5,191,179 | A * | 3/1993 | Yatchum et al. | 200/11 TC |
| 6,693,247 | B1 * | 2/2004 | Byers et al. | 200/11 TC |
| 7,649,147 | B2 * | 1/2010 | Xiao | 200/11 TC |
| 7,750,257 | B2 * | 7/2010 | Lindsey et al. | 200/11 TC |
| 7,838,786 | B2 * | 11/2010 | Bizard et al. | 200/501 |
| 2009/0211890 | A1 * | 8/2009 | Xiao | 200/337 |

FOREIGN PATENT DOCUMENTS

DE 3541888 A 6/1987

* cited by examiner

*Primary Examiner* — Michael Friedhofer
(74) *Attorney, Agent, or Firm* — Andrew Wilford

(57) ABSTRACT

The invention relates to a manual drive for a tap changer for a tap-changing transformer having a locking unit. The locking unit has a catch which can pivot and has different locking means; the catch can be operated from the outside before an intended switching operation. The locking unit offers high a degree as possible of safety against inadvertent or else deliberate incorrect operations of the manual drive.

7 Claims, 10 Drawing Sheets

MANUAL DRIVE FOR A TAP CHANGER FOR TAP-CHANGING TRANSFORMERS

CROSS REFERENCE TO RELATED APPLICATIONS

Figure 1:
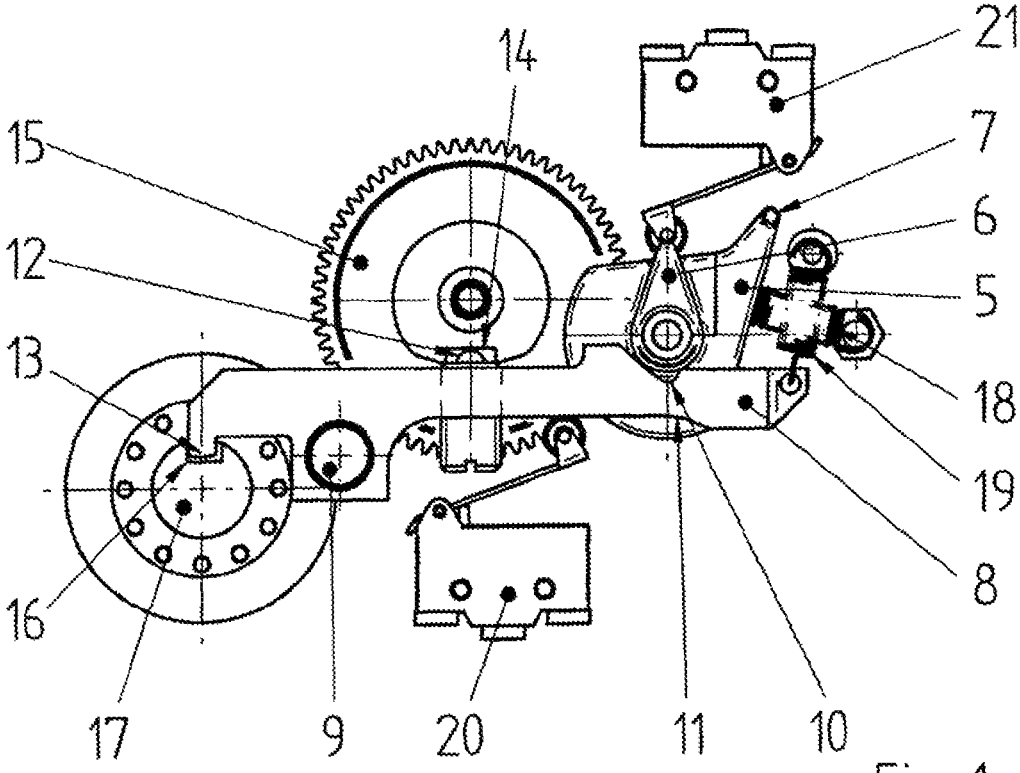

This application is the US national phase of PCT application PCT/EP2009/003657, filed 22 May 2009, published 4 Feb. 2010 as WO2010/012329, and claiming the priority of German patent application 102008036006.6 itself filed 1 Aug. 2008, whose entire disclosures are herewith incorporated by reference.

The invention relates to a manual drive for stepped, power-free actuation of a tap changer at a tapped transformer.

Such a manual drive is known from DE-OS 35 41 888. It consists of a housing, a drive shaft provided with a hand crank, a drive output shaft, a step-up transmission arranged therebetween and a numerical display for the respective connected position of the tap changer.

A further manual drive is known from the company publication of the applicant: 'Handantrieb BM75, Betriebsanleitung BA 109/03', published June 2004. Here, too, a hand crank for the manual actuation is provided. This manual drive comprises, for safety reasons, an unlocking lever which, after each switching action, is to be locked by a padlock so as to prevent operation by unauthorized parties. In addition, a locking contact switched over simultaneously with actuation of the unlocking lever is provided as a check.

Yet another manual drive, in which the hand crank is removable from the drive shaft and is fastened to the housing at the outside by a spring clip, is known from the further company publication of the applicant: 'Handantrieb MR404, Betriebsanleitung BA 23/02', published August 2004. In this embodiment the drive is unlocked by rotation of a key. In that case, a blocking lever is lifted out of a blocking disc and by a cam wheel; the drive shaft is released and can be rotated. The shaft leading to the tap changer is always rotated by a reduction transmission with one revolution per switching regardless of how many rotations the switching at the hand crank itself are required. At the conclusion of the switching the mentioned blocking lever is again detented by a tension spring in a cut-out of the blocking disc and in the cam wheel so that the drive is blocked. An electric cam switch is switched over at the same time. By virtue of a constrained latching, a new switching can take place only after repeated rotation of the key.

In summary, the known prior art can, in the case of manual drives of that kind, be characterized in the following terms: Three mechanical subassemblies are present, namely a load transmission for passing on to the tap changer the torque applied to the hand crank, a control transmission for transmitting the hand crank actuation to a display transmission and for activation of constrained locking means possibly present and the mentioned display transmission for visualization of the operating settings of the tap changer and for counting the devolved tap changes. The known manual drives additionally have safety devices to prevent unauthorized actuation.

However, it has proved that the manual drives, since they are usually provided for outside installation and in many cases are mounted unsupervised, are subject to numerous operating attempts contrary to intention. In part these are lay persons who quite simply disregard the operating instructions accompanying the apparatus, but in part also wilful attempts at incorrect actuation or outright vandalism. Apart from then inevitable damage to the apparatus or also operational disturbances in the tapped transformer this is, amongst other things, also of concern for product liability reasons.

It is the object of the invention to indicate a manual drive of the kind stated in the introduction which offers greatest possible mechanical and electrical security against incorrect operations and incorrect attempts of all kinds.

This object is fulfilled by a manual drive with the features of the first patent claim. The subclaims relate to advantageous developments of the invention.

The manual drive according to the invention comprises, in correspondence with the prior art, the already mentioned subassemblies of load transmission, control transmission and display transmission. According to the invention in that case the control transmission has a locking unit comprising a pawl by which the forces are absorbed if unauthorized persons wish to undertake switching contrary to function without actuating an unlocking unit. The invention offers overall the greatest possible security against faulty operations, whether unintentional due to lack of knowledge or even intentional.

Figure 2:
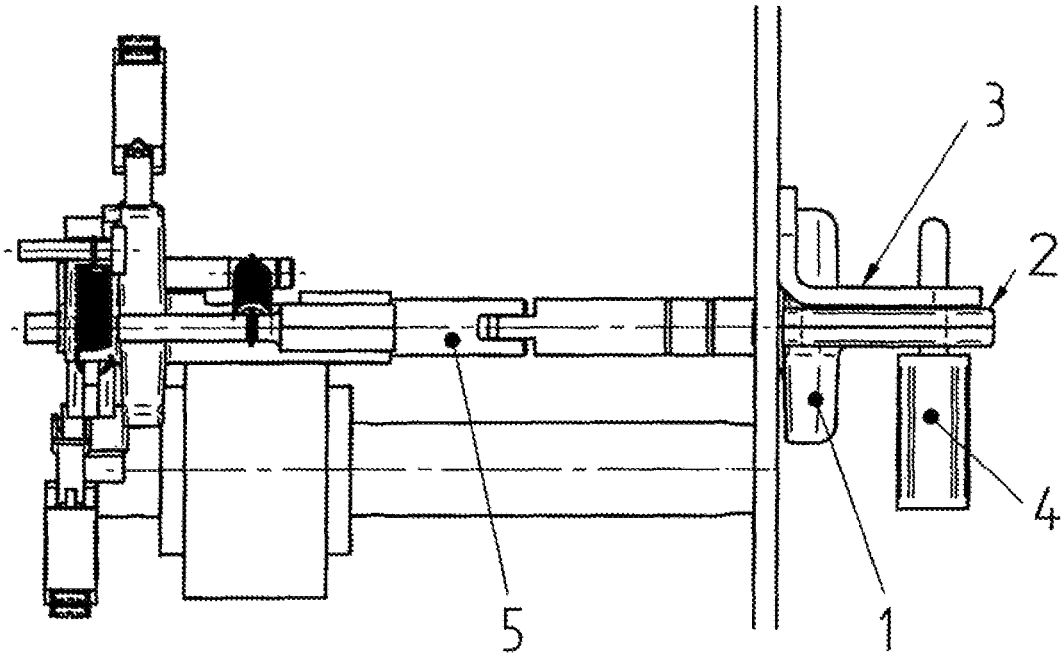
Figure 3:
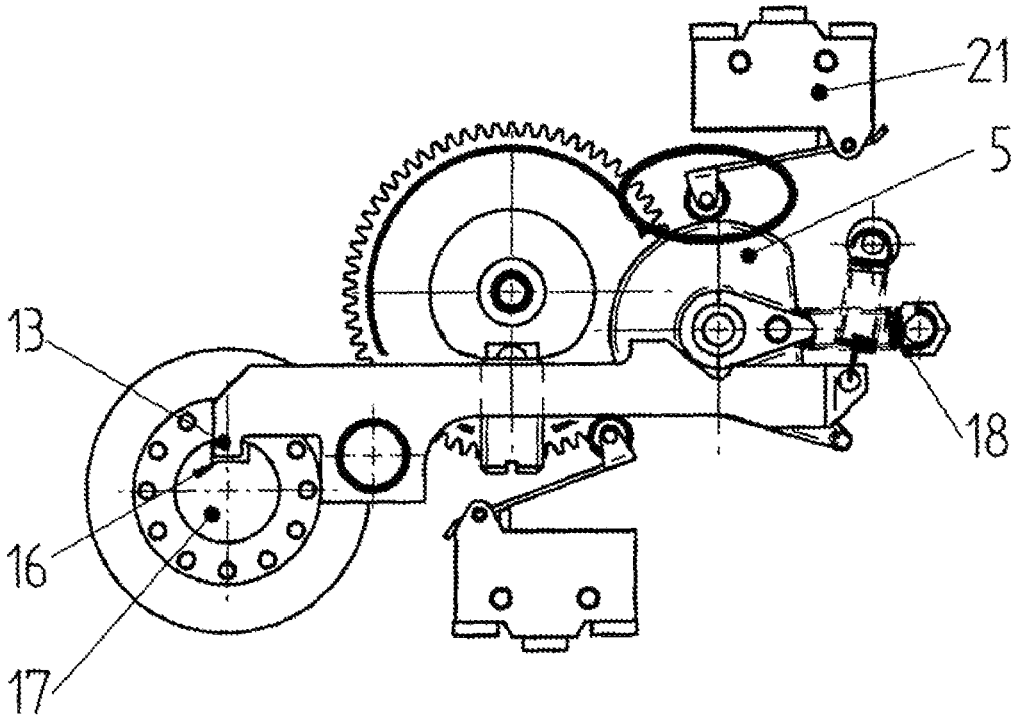
Figure 4:
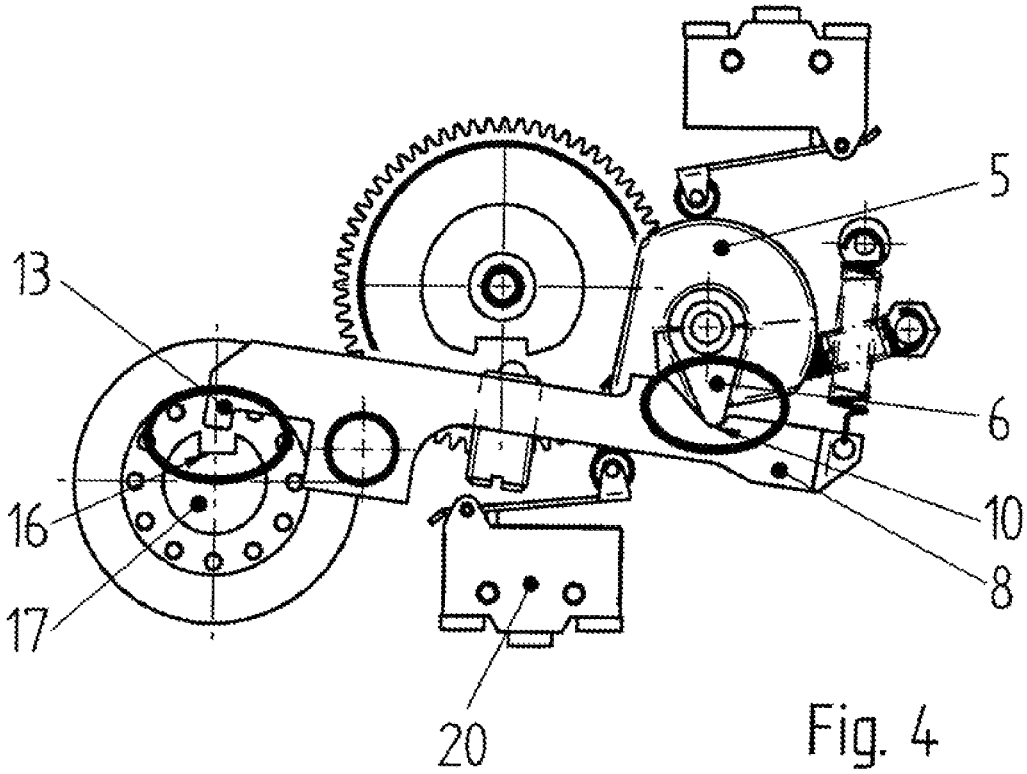
Figure 5:
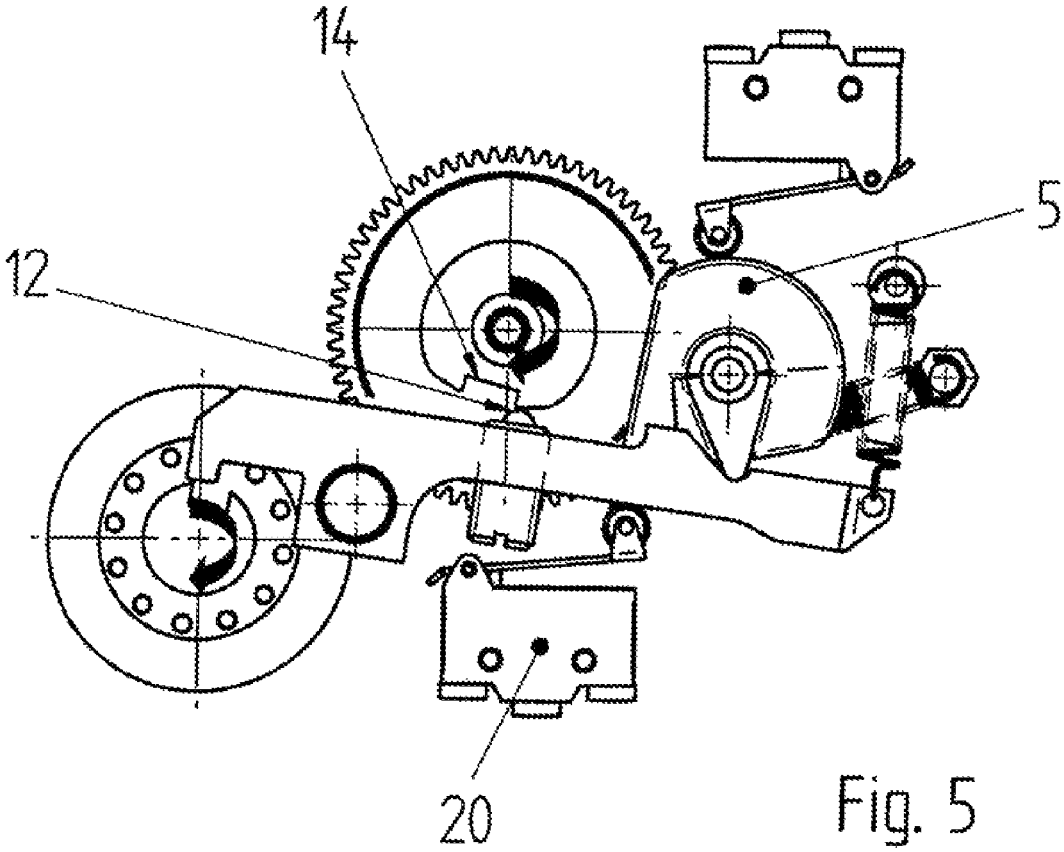
Figure 6:
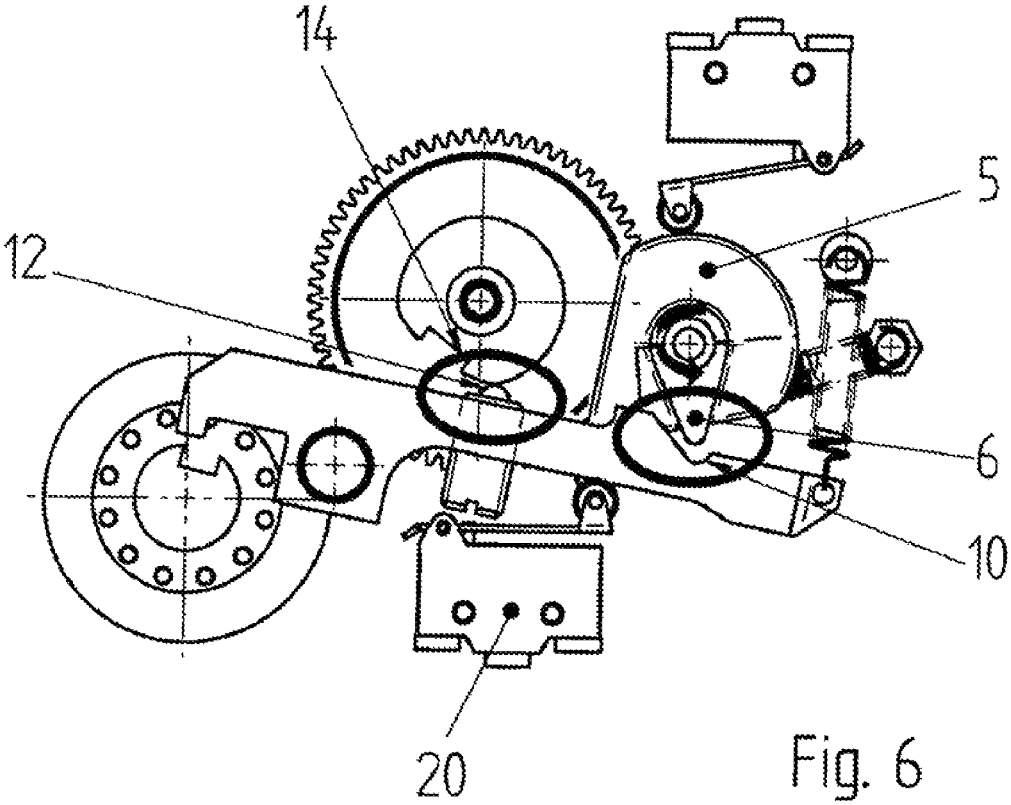
Figure 7:
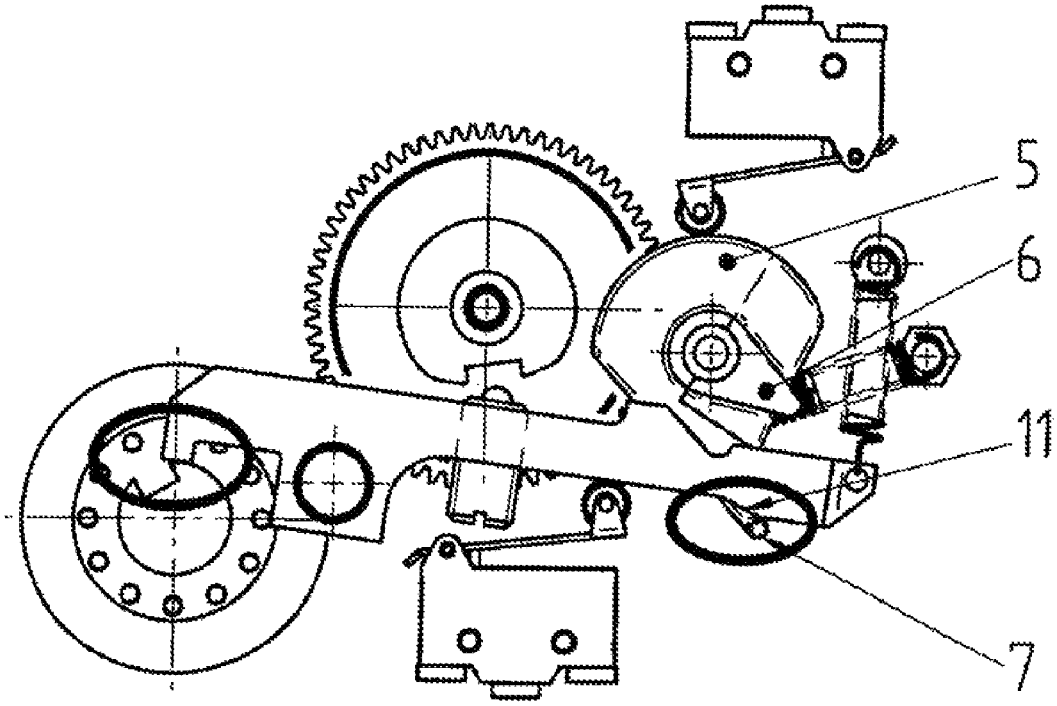
Figure 8:
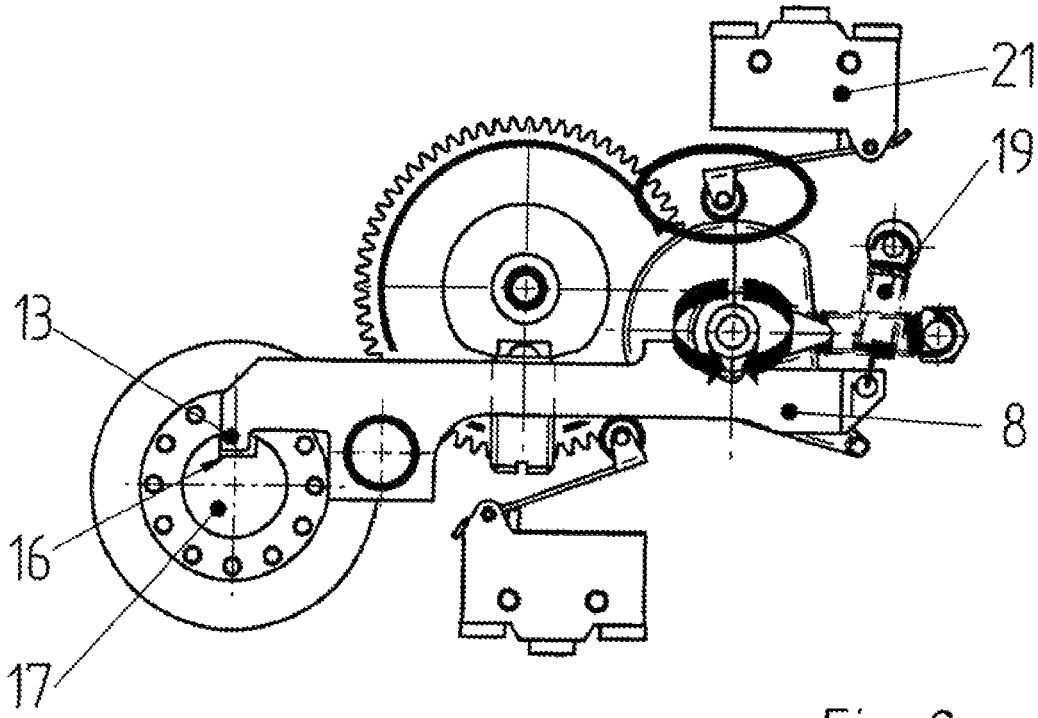

The invention shall be explained in more detail in the following by way of drawings, in which with respect to the figures:

FIG. 1 shows a locking unit of a manual drive according to the invention in the blocked state from behind, i.e. the housing side remote from the user, FIG. 2 shows this locking unit again, in side illustration, FIGS. 3 to 9 show this locking unit at different time instants during preparation for and execution of a tap change, i.e. actuation of the manual drive, from the front, and specifically:

FIG. 3 after removal of the securing padlock,

FIG. 4 after further rotation of the control part into the end position,

FIG. 5 at the start of rotation of the inserted hand crank,

FIG. 6 during further rotation of the hand crank,

FIG. 7 shortly before the conclusion of the tap change,

FIG. 8 after a completed tap change and

Figure 9:
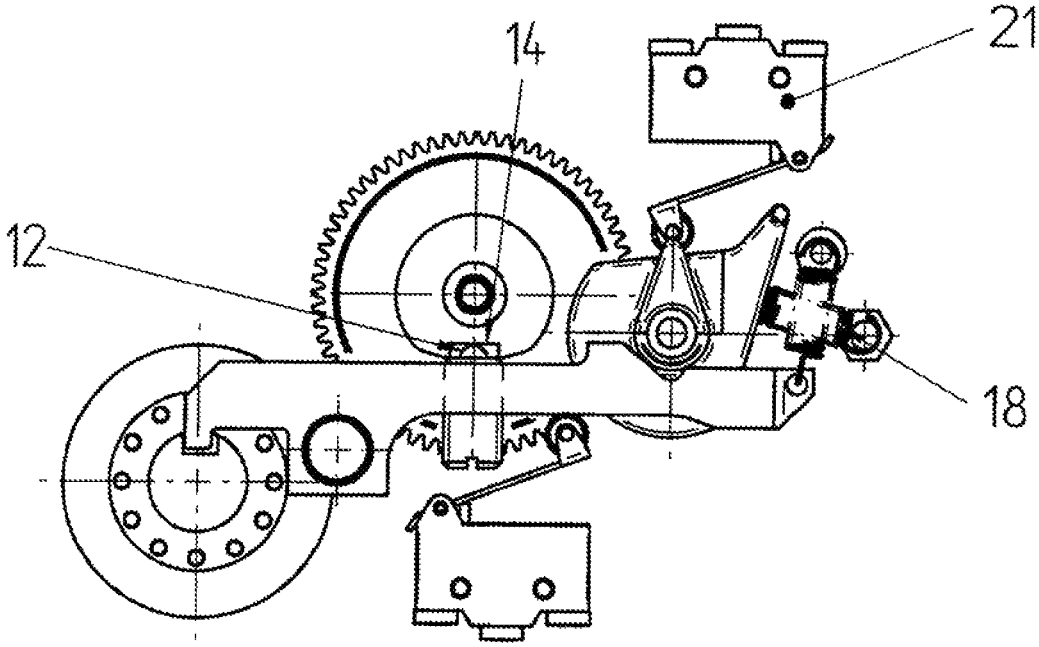

FIG. 9 during subsequent blocking, and

Figure 10:
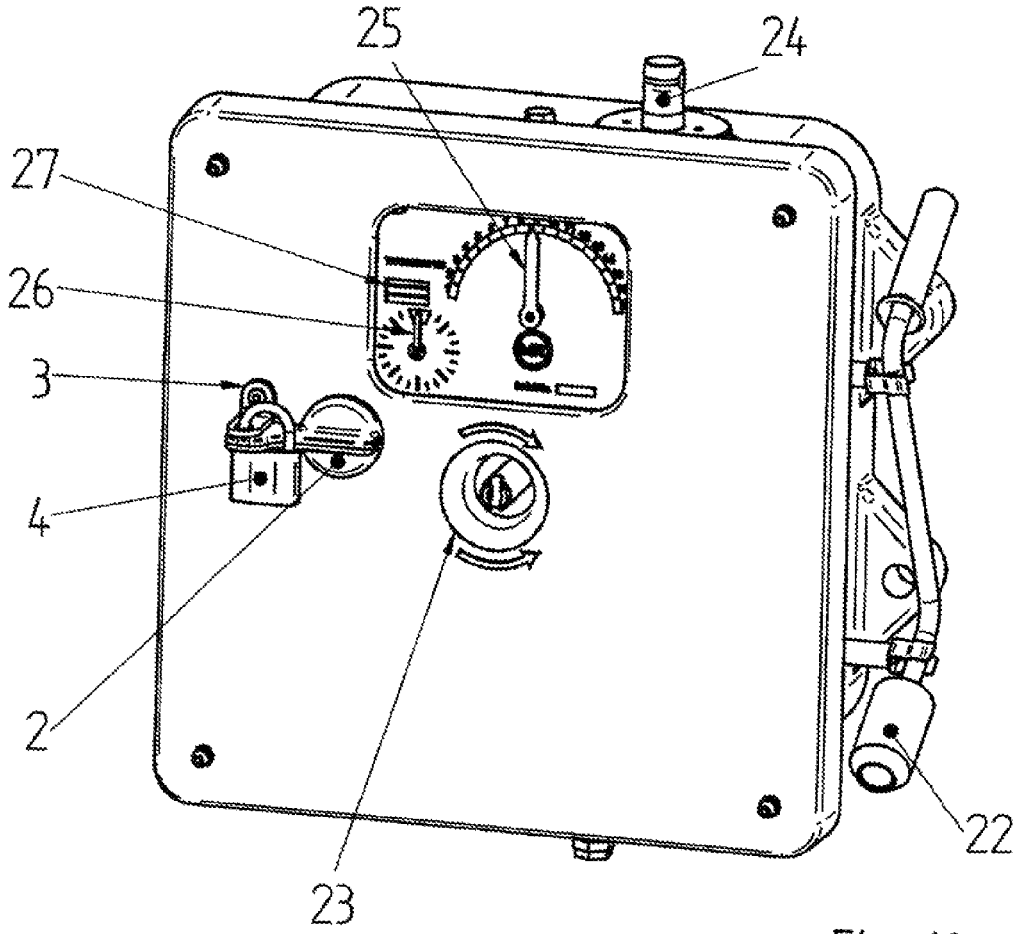

FIG. 10 shows a manual drive in full in perspective illustration from the front.

Initially FIGS. 1 and 2 that show a locking unit according to the invention in stationary, secured state, will be explained in more detail. An external key 1, at which an external control part 2 is formed, is disposed outside a housing (not illustrated). This external control part 2 cooperates with a fixed counter-member 3 against which it bears in the secured state and is fixed in this position by a padlock that is led through bores not only of the external control part 2, but also of the fixed counter-member 3. The external control part 2 is connected with an internal key 5 which has a cam 6 and, in addition, a blocking pin 7. External control part 2, external key 1 and internal key 2 are constructed to be rotatable. In addition, a pawl 8 mounted in a rotational axle 9 is provided. The pawl has a groove 10 which mechanically positively cooperates with the cam 6. At its side remote from the groove 10 it has a blocking profile 11 which mechanically positively cooperates with the blocking pin 7 as will be explained later in more detail. Also provided at the pawl 8 is a blocking cam 12 which is pivotable about the rotational axle 9 on the pawl 8 together with this. The blocking cam 12 is preferably displaceable perpendicularly to the length direction of the pawl 8 by a defined amount. At its other free end the pawl 8 additionally has a blocking pawl 13. The described blocking cam 12 cooperates with a groove 14 on a gear 15 of the control transmission. The described blocking pawl 13 for its part cooperates with a blocking groove 16 on the drive shaft 17. Also shown is a spring 18 that is articulated to the internal key 5, as well as a spring 19 that is articulated to the pawl 8. Finally, a microswitch 20 for actuation of the transformer circuit breaker as well as a microswitch 21 for generating an electrical lock release report are also illustrated. In this position the padlock 4 keeps the internal key 5 in the illustrated position.

In the figures described in the following only the components respectively necessary for explanation of the instantaneous setting and mode of function are again provided with reference numerals. FIG. 3 shows the locking unit after removal of the padlock 4. The internal key 5 is rotated to the right through 90 degrees by the spring 18. At the same time, the microswitch 21 is actuated and removal of the padlock 4 thus electrically signaled. It can be seen that the blocking pawl 13, which is detented in the blocking groove 16, still blocks the drive shaft 17.

FIG. 4 shows the device after complete unblocking, i.e. further rotation of the control part into the end position. In that case, the external control part 2 and thus the internal key 5 are rotated further to the right against the spring force. As a consequence, it impinges by its cam 6 on the pawl 8, presses this downwardly and finally detents in the groove 10. During this movement of the pawl 8 the microswitch 20 is triggered for actuation of the transformer circuit breaker so that it is ensured the transformer is switched free of voltage. Only in the end setting of this unblocking, as shown in FIG. 4, is the drive shaft 17 released, because the blocking pawl 13 is led out of the blocking groove 16. The manual drive is thus operationally ready; only now can the drive shaft be actuated by a plugged-on hand crank. Up to this point in time an intended tap change can still be interrupted.

FIG. 5 shows the device at the beginning of rotation of the hand crank. The blocking cam 12 is out of engagement with the groove 14. Through rotation of the hand crank the groove 14 is also rotated by the control transmission and in that case the groove 14 makes exactly one revolution for eight hand crank revolutions. After the start of rotation the blocking cam 12 runs beyond the groove 14 by its profile and the cam 6 can, due to spring force, jump out of the groove 10. This is shown in FIG. 6. The release of the pawl 8 for possible detenting in the groove 16 of the drive shaft 17 takes place only after seven revolutions, since the gear 15 and thus the groove 14 execute only one revolution per tap change. In the exemplifying embodiment explained here the starting point is eight revolutions of the drive shaft 17. However, this is not absolutely necessary; a different number of revolutions is also possible. However, by appropriate design of the transmission it is ensured in every case that the groove 14 executes exactly one revolution for each tap change.

The internal key 5 is now no longer blocked by the groove 10, but by the cooperation of the blocking pin 7 that now impinges on the blocking profile 11. FIG. 7 shows this: the blocking pin 7 is blocked by the profile 11.

FIG. 8 shows the device after completely concluded switching, in which the blocking pawl 13 is detented and thus the drive shaft 17 blocked by the blocking pawl 13. As explained, the blocking pawl 13 is urged back into the blocking groove 16 and thus, by virtue of the spring 19, the entire pawl 8 has been pivoted. The lock release report by the microswitch 21 is still active in this position.

FIG. 9 finally shows the device at the time of blocking. If the user has decided, the external control part 2—not illustrated here—is manually pivoted again against the force of the spring 18 so that it bears against the fixed counter-member 3 and the padlock 4 can be introduced that fixes the elements in this position. Indication of the lock release by the microswitch 21 is cancelled again.

It can be seen from the illustrated sequence that the device according to the invention combines different protective functions. On the one hand, the drive shaft 17 is and remains blocked as long as the padlock 4 has not been removed and beyond that the control part 2 has not been further rotated quite intentionally against the force of the spring 18 into the operating setting. Moreover, it is only possible to perform each time one complete tap change, here consisting of eight revolutions of the drive shaft 17. This takes place through the cooperation of the blocking cam 12 and the groove 14. If an operator during a tap change interrupts the rotational movement after less than eight revolutions, the intermediate states, which are illustrated in FIGS. 5 and 6 and in which the microswitch 20 allows switching-off of the transformer circuit breaker, result and it is not possible to lock or block the device. The reason why not is because the internal key 5 remains blocked. Moreover, it is not possible to execute more than eight revolutions, since after exactly eight revolutions, i.e. one complete revolution of the groove 14, the blocking cam 12 of the pawl 8 drops back into this groove 14, whereby the drive shaft 17 is also blocked again, because the pawl 8 has rotated about the fulcrum 9. This blocking can be overcome, only quite intentionally, by repeating actuation of the external control part 2.

FIG. 10 shows once more a complete manual drive according to the invention from the outside. Shown here are the hand crank 22 that is usually attached laterally to the housing, an introduction opening 23 for this hand crank 22 as well as, at the upper side of the housing, a drive output shaft 24 leading to the tap changer to be actuated. Also shown are the setting display 25 that illustrates the respective currently connected tap of the tap changer, a switching step display 26 and a counter 27. The switching step display 26 executes exactly one revolution for each tap change—analogously to the groove 14 of the gear 15 of the control transmission—and thus provides information about the current state of the respective end switching. If the pointer of this switching step display 26 has again reached its initial position, the switching is concluded.

The invention claimed is:

1. A manual drive for stepped, power-free actuation of a tap changer of a tapped transformer, the manual drive comprising:

a drive shaft at which a plurality of revolutions for each tap change are manually executed;

a control transmission reducing these revolutions to exactly one revolution of a gear per tap change; and a locking unit having a blocking pawl that blocks the drive shaft and that is detented in a blocking groove of the drive shaft as long there is no manual unlocking by an external rotatable control part, a rotatable internal key connected with the external control part, and a pawl pivotable about an axis of rotation and having a blocking pawl cooperating with the blocking groove of the drive shaft and a blocking cam cooperating with a groove of the gear of the control transmission and such that through actuation of the internal key the pawl is so pivotable out of the locking position that the blocking pawl and the blocking cam come out of engagement with the respective grooves.

2. The manual drive according to claim 1, wherein the internal key comprises a cam as well as a blocking pin and that the pawl has at one free end thereof a groove cooperating with the cam as well as a blocking profile cooperating with the blocking pin.

3. The manual drive according to claim 2, wherein the blocking pawl is arranged at the free end of the pawl remote from the groove.

4. The manual drive claim 1, wherein a spring is so articulated to the internal key that the internal key can be urged into the unlocking setting against the force of the spring.

5. The manual drive according to claim 1, wherein a spring is articulated to the pawl.

6. The manual drive according to claim 1, further comprising a microswitch that actuates the transformer circuit breaker and in turn is actuatable by the pawl on deflection thereof from the locking position.

7. The manual drive according to claim 1, further comprising a microswitch that electrically signals the unlocking and is actuatable by the internal key.

* * * * *